US009211009B2

(12) United States Patent
Greenwood

(10) Patent No.: US 9,211,009 B2
(45) Date of Patent: Dec. 15, 2015

(54) APPARATUS FOR STORING AND RETRIEVING VARYING SHAPED AND SIZED SPICE BOTTLES OR CONTAINERS

(71) Applicant: Youcopia Products Inc., Arlington Heights, IL (US)

(72) Inventor: Mark Greenwood, Arlington Heights, IL (US)

(73) Assignee: YOUCOPIA PRODUCTS, INC., Chicago, IL (US)

( * ) Notice: Subject to any disclaimer, the term of this patent is extended or adjusted under 35 U.S.C. 154(b) by 87 days.

(21) Appl. No.: 13/630,936

(22) Filed: Sep. 28, 2012

(65) Prior Publication Data

US 2014/0091685 A1 Apr. 3, 2014

(51) Int. Cl.

| | |
|---|---|
| ***A47B 88/18*** | (2006.01) |
| ***A47B 88/20*** | (2006.01) |
| ***A47B 73/00*** | (2006.01) |
| ***A47B 77/16*** | (2006.01) |

(52) U.S. Cl.

CPC ..... *A47B 88/18* (2013.01); *A47B 73/00* (2013.01); *A47B 77/16* (2013.01); *A47B 88/20* (2013.01)

(58) Field of Classification Search

CPC ..... A47B 73/00; A47B 88/06; A47B 77/16; A47B 88/18; A47B 88/20; A47F 7/28; A47F 7/283

USPC ..... 312/322, 323, 330.1, 348.3, 45, 72; 211/59.2, 74; D7/600.1, 701

See application file for complete search history.

(56) References Cited

U.S. PATENT DOCUMENTS

| | | | | |
|---|---|---|---|---|
| 242,607 | A * | 6/1881 | Cutler | 206/391 |
| 1,303,090 | A | 5/1919 | McCray | |
| 2,606,091 | A | 8/1952 | Marion et al. | |
| 2,839,349 | A | 6/1958 | Culver | |
| 2,919,814 | A * | 1/1960 | Berkowitz | 211/74 |
| 3,013,853 | A | 12/1961 | Toms | |
| 3,339,994 | A | 9/1967 | Reddig et al. | |
| 3,355,231 | A * | 11/1967 | Kegel | 312/45 |
| 4,228,903 | A * | 10/1980 | Eckert | 211/59.2 |
| 4,343,244 | A | 8/1982 | Moriarty et al. | |
| 4,356,923 | A * | 11/1982 | Young et al. | 211/59.2 |
| 4,441,771 | A | 4/1984 | Roesler | |
| 4,502,741 | A | 3/1985 | DeVries et al. | |
| 4,620,489 | A | 11/1986 | Albano | |
| 5,244,272 | A | 9/1993 | Thompson | |
| 5,348,207 | A | 9/1994 | Frank | |

(Continued)

OTHER PUBLICATIONS

Spicestack, Inc., Spice Stack Organizer (brochure), 2006, United States.

*Primary Examiner* — James O Hansen
(74) *Attorney, Agent, or Firm* — Knechtel, Demeur & Samlan

(57) ABSTRACT

A portable spice rack that comprises a square or rectangular shaped housing and a plurality of spice drawers which are stacked vertically within the housing. The spice drawers provide a plurality of compartments that are uniquely designed to accommodate storing and retrieving varying shaped and sized spice bottles or other types of containers. Specifically, the spice drawer provides a substantially rectangular compartment having a base further providing a slot formed by an opening and opposed supporting walls. The rectangular compartment and slot within the base coact to enable, in particular, square, rectangular, and/or circular spice bottles or containers, or any combination thereof, to be stored and retrieved at the same time within any of the plurality of compartments within the spice rack.

8 Claims, 4 Drawing Sheets

(56) References Cited

U.S. PATENT DOCUMENTS

| | | | | | |
|---|---|---|---|---|---|
| 5,385,399 | A | | 1/1995 | Weidner | |
| D365,732 | S | * | 1/1996 | Kellen et al. | D7/701 |
| 6,039,422 | A | | 3/2000 | Butters et al. | |
| 6,122,173 | A | | 9/2000 | Felcman et al. | |
| 6,129,219 | A | * | 10/2000 | Peickert | 211/74 |
| 6,332,546 | B1 | | 12/2001 | Hunt | |
| 6,585,334 | B2 | | 7/2003 | Cheng et al. | |
| 6,626,509 | B2 | | 9/2003 | Remmers | |
| 7,063,219 | B2 | | 6/2006 | Fann et al. | |
| D661,950 | S | * | 6/2012 | Greenwood | D7/590 |
| 2002/0066708 | A1 | * | 6/2002 | Gerard | 211/74 |
| 2007/0228909 | A1 | * | 10/2007 | Hwang et al. | 312/408 |

* cited by examiner

APPARATUS FOR STORING AND RETRIEVING VARYING SHAPED AND SIZED SPICE BOTTLES OR CONTAINERS

I. CROSS-REFERENCE TO RELATED APPLICATION

Not applicable.

II. FIELD OF THE INVENTION

This invention relates to spice racks and, more particularly to an improved spice rack for organizing, storing, and retrieving varying shaped and sized spice bottles or other types of containers.

III. DESCRIPTION OF THE PRIOR ART

In any kitchen of a home or restaurant where a sufficient amount of cooking and eating occurs, there exists a variety of spices to assist in the flavoring of the cooking and/or to complement any meal. At any given time, an average cook might have approximately twenty (20) to thirty (30) spices available with each spice being contained in its own individually sized, bottle or container.

With so many spices available and the large number of individually sized bottles or containers for each spice, this presents several inherent issues for the cooks in these kitchens. For example, where are all of the spice bottles or containers to be stored without consuming an inordinate amount of space in the kitchen. How are all of the spices to be organized for ease of viewing and later use. And, how are all of the spices to be easily retrieved without disturbing the organization of the rest of the spices not being used.

To attempt to solve these issues, there have been many products designed over the years in an attempt to try and help people organize, store and retrieve their spices for cooking purposes. Unfortunately, these designs still present various problems.

For example, in the kitchens of today, one option may be to put them in a spice drawer. Typically, there are plastic inserts which fit inside drawers that can hold individual spices. The problem with this concept is the amount of wasted space in what could otherwise be a better used storage space. And of course, the spice bottles or containers could simply be put up on a shelf. The obvious problem with this is that the spice bottles or containers behind those in the front are not visible and can be difficult to reach.

Initial solutions to this problem were counter-top spice racks which ranged from horizontal racks to spinning towers. The problem with these types of spice racks is that the spice rack is unable to hold a sufficient number of spice bottles or containers. Moreover, of the spice bottles or containers that the spice rack can hold, the spice bottles or containers consume an inordinate amount of space on what is typically a very crowded counter-top.

Another type of spice rack is the 'lazy-susan' spinning carousel. This product likewise has several drawbacks. When the carousel is spun around, the centrifugal force exerted upon the spice bottles or containers forces many of the spice bottles or containers to fall off the spice rack. Compounding this problem is that, if the spinning carousel is placed in a cabinet, the spice bottles or containers can become lodged in the back of the cabinet preventing the carousel from spinning. A circular spinning rack also wastes valuable space in a square cabinet. Additionally, spice bottles or containers kept in the center of such a spice rack are also difficult to retrieve without knocking down other surrounding spice bottles or containers.

Another type of spice rack which may be employed in a kitchen is an expandable, plastic 3-tier step. The idea of this spice rack is to provide the spice bottles or containers in a stair-step fashion so that the cook can visually see the spices. In concept, it makes sense. In reality, it poses several problems. For example, the labels on the second and third step end up being covered by the spice bottles or containers provided in the step below; it is difficult for some people to easily retrieve the spice bottles or containers from these various steps; and these types of expandable devices waste a lot of space.

In an attempt to solve many of these problems, Applicant designed its own spice rack as illustrated and described in its Spice Stack Organizer brochure from 2006. Among its features, this spice rack provided for a curved compartment in the spice drawers. Although the curvature of this compartment was designed to accommodate circular shaped spice bottles or containers, this compartment cannot and, is unable to, accommodate square or rectangular shaped spice bottles or containers. Thus, the inherent problem with this spice rack is that circular shaped spice bottles or containers is only shape that this spice rack can accommodate, to the exclusion of all other shapes, including square or rectangular.

While the above is not exhaustive and there may be other design iterations of the spice rack, they all seem to share one or more of the common problems described above. Thus, there is a need and there has never been disclosed Applicant's unique portable spice rack for organizing, storing, and retrieving varying shaped and sized spice bottles or other types of containers.

IV. SUMMARY OF THE INVENTION

The present invention is a portable spice rack that comprises a square or rectangular shaped housing and a plurality of spice drawers which are stacked vertically within the housing. The spice drawers provide a plurality of compartments that are uniquely designed to accommodate storing and retrieving varying shaped and sized spice bottles or other types of containers. Specifically, the spice drawer provides a substantially rectangular compartment having a base further providing a slot formed by an opening and opposed supporting walls. The rectangular compartment and slot within the base coact to enable, in particular, square, rectangular, and/or circular spice bottles or containers, or any combination thereof, to be stored and retrieved at the same time within any of the plurality of compartments within the spice rack.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
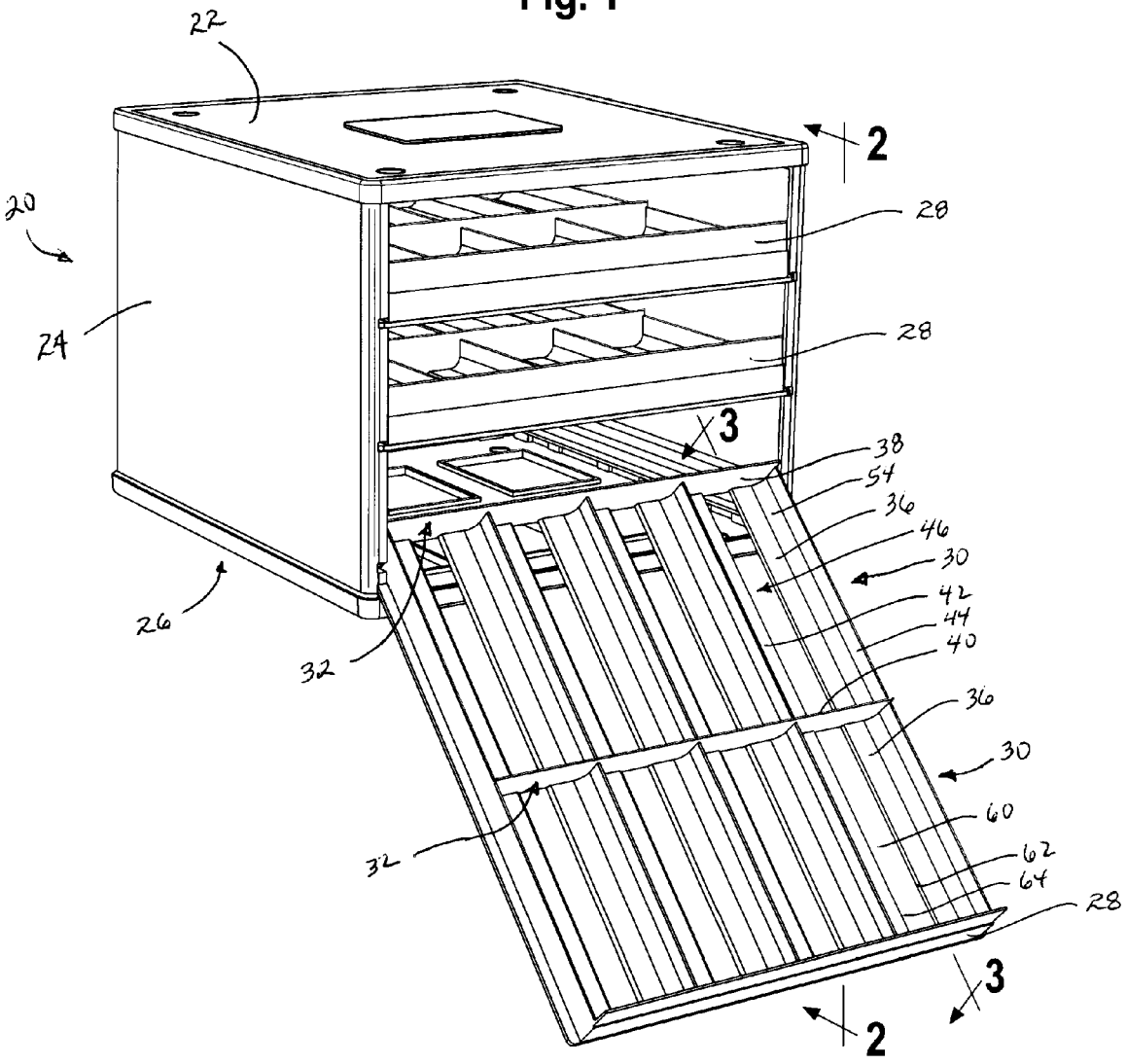
FIG. 1 is a perspective view of Applicant's portable spice rack and, in particular, illustrating the spice drawer in the angled, fully extended position and displaying the unique plurality of compartments.

Referring to FIG. 1, Applicant's portable spice rack 20 is illustrated. The spice rack 20 comprises a top panel 22, side panels 24, and a bottom panel 26. In the preferred embodiment, the top panel 22, the side panels 24, and the bottom panel 26 coact to form the shape of a square or rectangle for the spice rack 20. Alternatively, it is contemplated that any other shape may be used provided that the spice rack 20 is used as described herein. The spice rack 20 can rest on a supporting surface such as a cabinet shelf, counter-top, table, or any other type of suitable surface.

The spice rack 20 and, more specifically, the top panel 22, side panels 24, and bottom panel 26 are secured to one another to form the shape of the spice rack 20. A back panel may also be included to provide further support in connecting the top panel 22, the side panels 24, and the bottom panel 26 and for forming an integrated unit. The spice rack 20 may be assembled and/or manufactured by any means known to one skilled in the art including but not limited to being frictionally assembled using recesses and detent members, fixedly assembled using screws or other like devices, and/or integrally molded together. The spice rack 20 is also preferably constructed or made of a durable plastic material or, alternatively, of any type of materials known to one skilled in the art.

Figure 2:
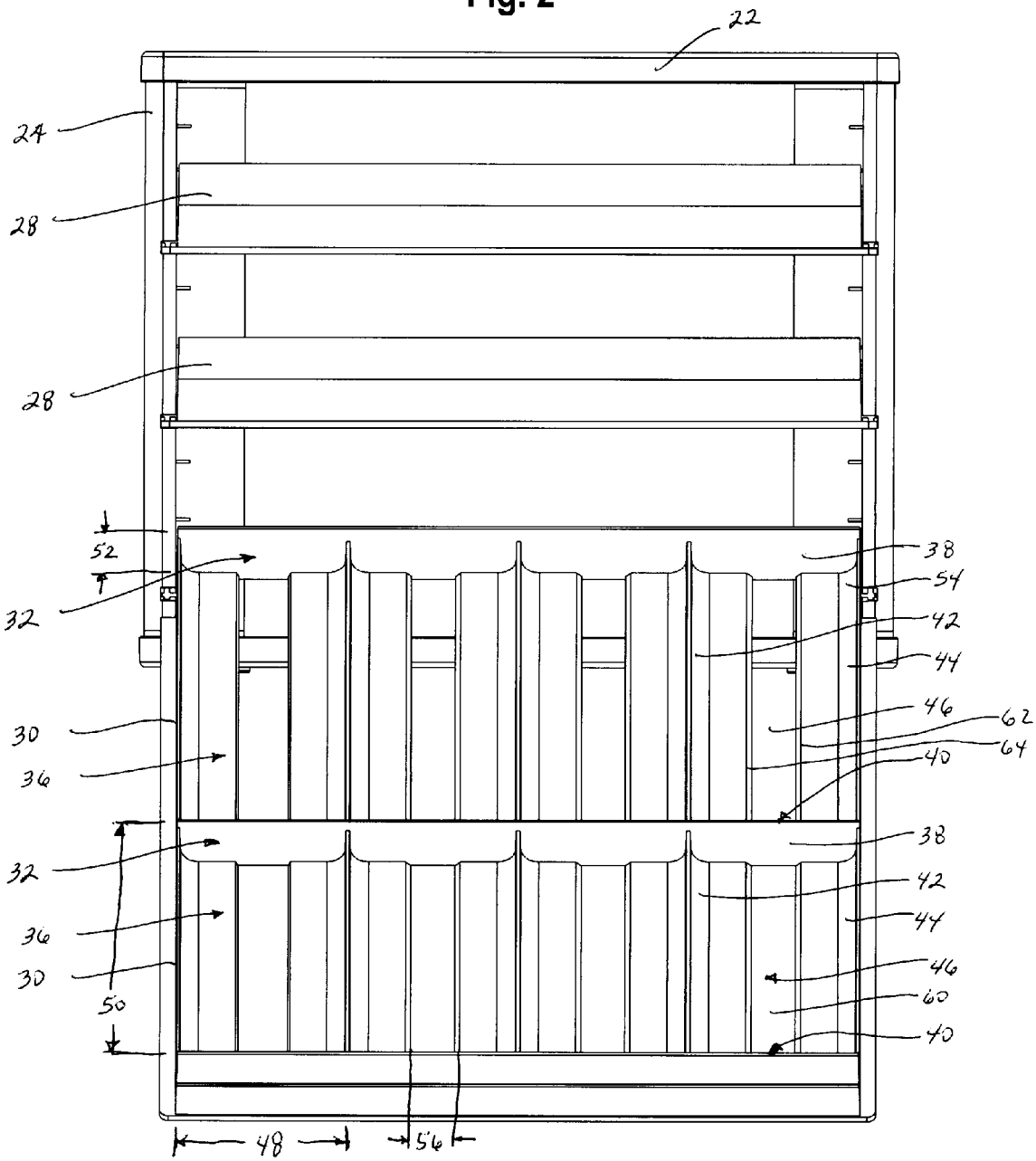
FIG. 2 is a front view, taken along line 2-2 of FIG. 1, of the portable spice rack and, in particular, illustrating one of the spice drawers of the spice stack and the unique plurality of compartments.

Situated between the side panels 24 of the spice rack 20, as illustrated in FIGS. 1 and 2, are a plurality of spice drawers 28. In the preferred embodiment, the spice rack 20 has three spice drawers 28 and each spice drawer 28 is designed to store a plurality of bottles or containers 34 (also referred to herein as "spice bottles") (see FIGS. 3 and 4). In the preferred embodiment, the bottles or containers 34 are made of a durable plastic material and contain various spices. Alternatively, the bottles or containers 34 may be made of any type of material known by one skilled in the art and contain any food, ingredient, liquid, or any other type of product as desired by the user. For example, in a non-limiting example, the spice bottles or containers 34 may be used for storage of other packaged goods and/or used in a similar manner in other parts of the house or office as well. Such packaged goods or items include but are not limited to soup cans, canned vegetables, canned goods, storage containers, spray paint bottles, paint cans, hobby paint bottles, craft paint bottles, craft supplies, spools of thread, fishing gear, or hardware goods such as screws, nails, drill bits, tool attachments, etc. Additionally, beer, soda or pop cans, wine bottles, liquor, bottled goods or virtually any other type of packaged goods item typically found in a home may be stored in this type of device.

In order to accommodate the most efficient number of spice drawers 28 within the spice rack 20, the spice drawers 28 are stacked vertically on top of one another thereby maximizing the space within the spice rack 20 and the unused space in a typical cabinet or counter-top. Alternatively, the spice rack 20 may be larger or smaller to accommodate more or less spice drawers 28 depending upon the needs or requirements of the user.

The plurality of spice drawers 28 are segregated into multiple adjacent rows 30 with each row 30 providing a plurality of compartments 32. The plurality of compartments 32 are each configured to receive spice bottles 34. In the preferred embodiment, the plurality of compartments 32 are designed to accommodate variations in the shapes and sizes of various spice bottles 34.

In the preferred embodiment, each of the plurality of compartments 32 have a base 36 that is substantially flat and providing a slot 46, a top wall 38, a bottom wall 40, and sidewalls 42 and 44. The top wall 38, the bottom wall 40, and sidewalls 42 and 44 are raised upwardly and/or vertically substantially the same height 52 (see FIG. 2) from the base 36, each forming a substantially perpendicular or ninety degree (90°) angle to the base 36 and substantially rectangular shape.

The sidewalls 42 and 44 and the base 36 form a curvature 54 between them having a radius R (see FIG. 4) of substantially equal to 0.250 inches. The top wall 38 and the bottom wall 40 each extend the entire width 48 (see FIG. 2) or W (also shown in FIG. 4) of the base 36 from sidewall 42 to sidewall 44. In the preferred embodiment, the width 48 or W of the base 36 is substantially equal to 2.25 inches. The sidewalls 42 and 44 each extend the entire length 50 of the base 36 from the top wall 38 to the bottom wall 40.

Figure 4:
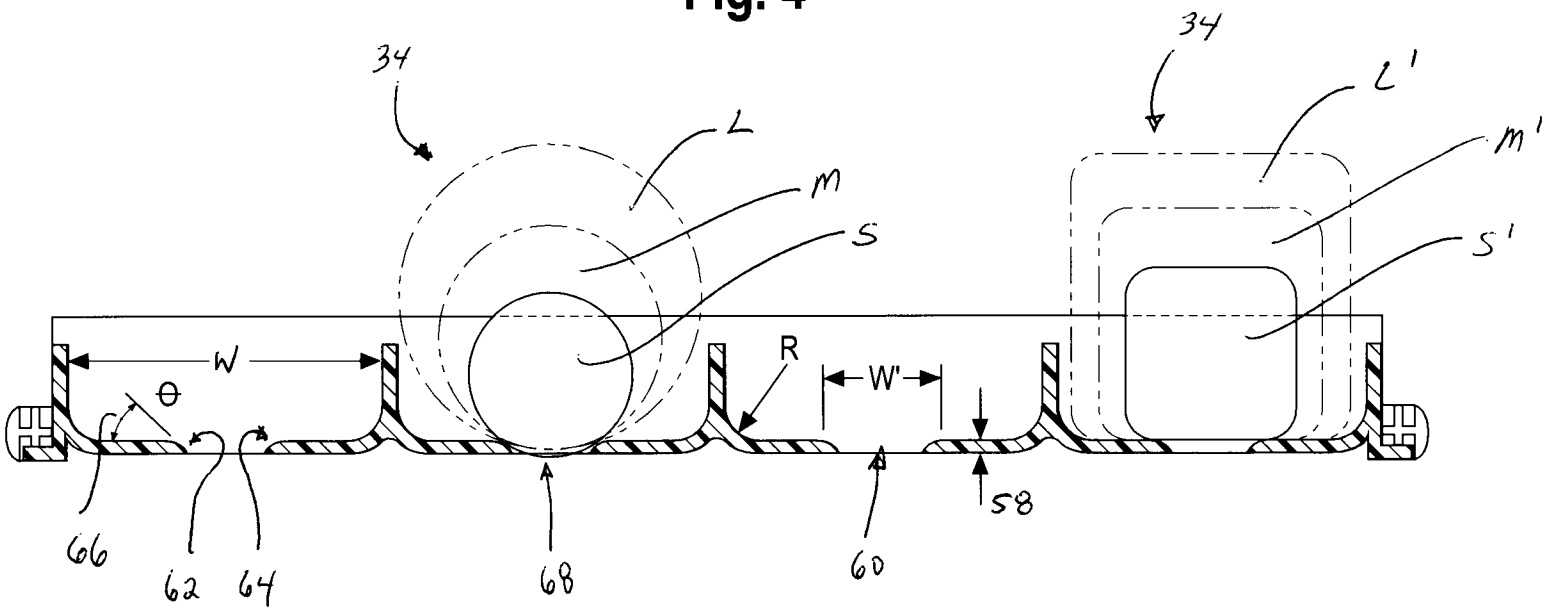
FIG. 4 is a cross sectional view, taken along line 4-4 of FIG. 3, illustrating one of the spice drawers of the spice stack and, in particular, displaying square, rectangular, and circular shaped and sized spice bottles as held in position within the same compartment of the spice drawer for organizing, storing, display, and retrieval.

The slot 46 is formed from the combination of an opening 60 and supporting walls 62 and 64 (see also FIG. 4). The slot 46 and the opening 60 each extend along the entire length 50 of the base 36 from the top wall 38 to the bottom wall 40. In the preferred embodiment, the supporting walls 62 and 64 are situated at an angle 66 or $\Theta$ (see FIG. 4) to the base 36 within the opening 60. The supporting walls 62 and 64 and the base 36 are slightly curved forming this angle 66, as illustrated. Alternatively, the supporting walls 62 and 64 and the base 36 may form this angle 66 with no curvature making it a hard angle. In the preferred embodiment, the angle 66 or $\Theta$ is substantially equal to forty-five degrees (45°). The slot 46 is situated in substantially the center of the base 36 and has a slot width 56 (see FIG. 2) or W' (also shown in FIG. 4) and a slot thickness 58 (see FIG. 4). In the preferred embodiment, the slot width 56 or W' is substantially equal to 0.750 inches and the slot thickness 58 is substantially equal to 0.060 inches.

Figure 3:
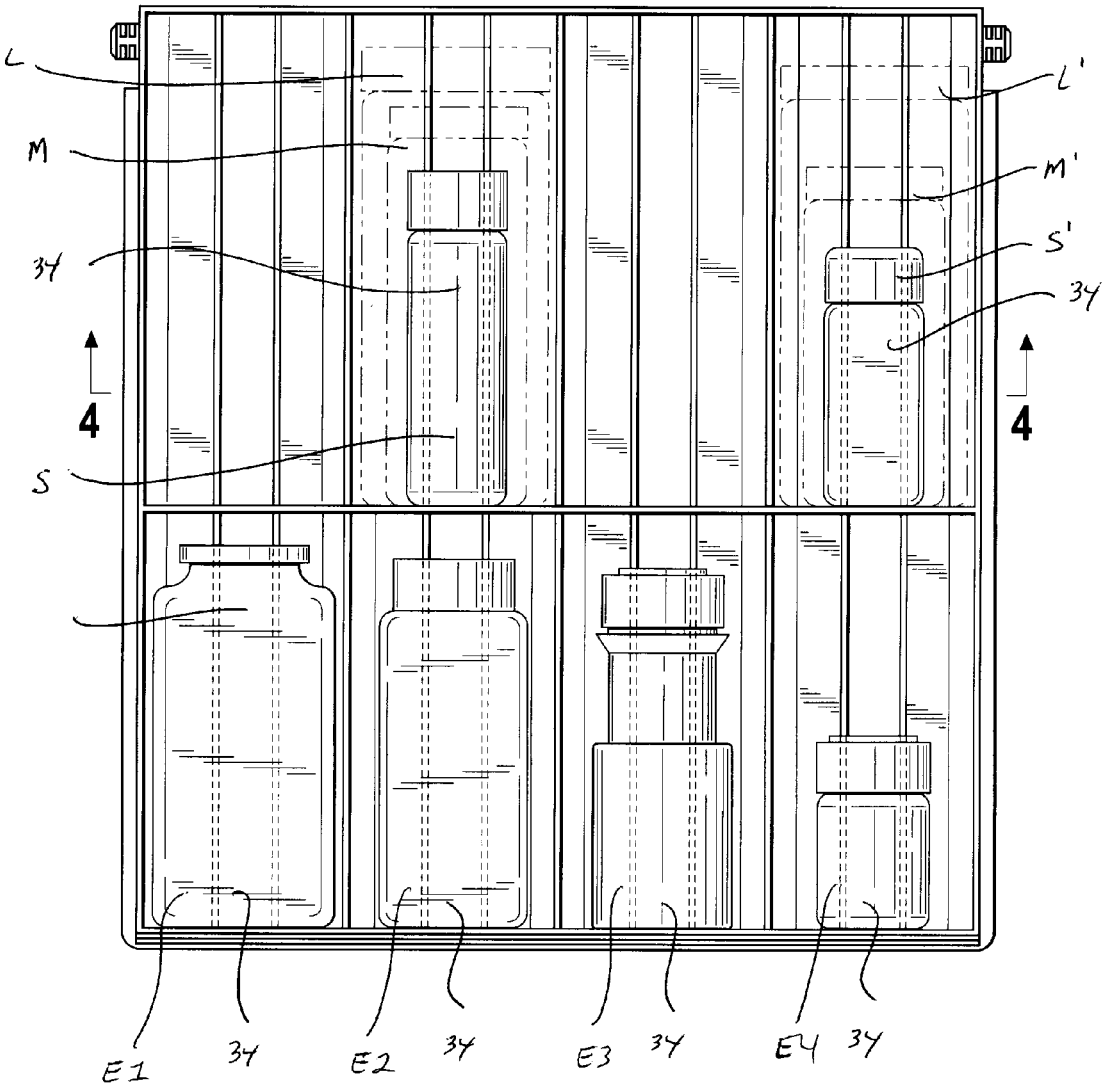
FIG. 3 is a front view, taken along line 3-3 of FIG. 2, illustrating one of the spice drawers of the spice stack and, in particular, displaying varying shaped and sized spice bottles as held in position within the same compartment of the spice drawer for organizing, storing, display, and retrieval.

As illustrated in FIGS. 3 and 4, this type of configuration enables each of the pluraltiy of compartments 32 to accommodate varying shapes and sizes of spice bottles 34 that can be purchased in typical grocery stores and/or that may be used by the user. A typical spice bottle 34 is either circular, or square or rectangular in shape. If the spice bottle 34 is circular in shape, the spice bottle 34, for example, may be sized as small, medium, and/or large depending on the radius of the circular shape of the spice bottle 34. In a non-limiting example as illustrated in FIGS. 3 and 4, these various sized, circular spice bottles 34 are identified with an S, M (as illustrated in phantom), and L (also illustrated in phantom). Likewise, if the spice bottle 34 is square or rectangular in shape, the spice bottle 34, for example, may be sized as a small, medium, and/or large depending upon the area of the square or rectanglar shape of the spice bottle 34. In a non-limiting example as illustrated in FIGS. 3 and 4, these various sized, rectangular spice bottles 34 are identified with an S', M' (as illustrated in phantom), and an L' (also illustrated in phantom). Alternatively, it is contemplated that the plurality of compartments 32 may be configured to receive any shape or sized spice bottle 34.

Depending upon the size of the spice bottles 34, the spice bottles 34 may be stacked one on top of the other within a compartment 32, referred to as double stacking. For example, this stacking may include but is not limited to a circular shaped bottle stacked above or with another circular shaped spice bottle; a circular shaped bottle stacked above or with a rectangular shaped spice bottle; a circular shaped bottle stacked above or with a square shaped spice bottle; a rectangular shaped bottle stacked above or with another rectangular shaped spice bottle; a rectangular shaped bottle stacked above or with a square shaped spice bottle; a square shaped bottle stacked above or with another square shaped spice bottle; or any other configuration or stacking as desired by the user.

In use, the top wall 38, the bottom wall 40, sidewalls 42 and 44, and base 36 are substantially formed into a rectangular shape and thereby coact to receive any square, rectangular, or other similar shaped or sized spice bottles 34. When a square, rectangular, or other similar shaped or sized spice bottles 34 are inserted into one of the plurality of compartments 32, the sides of the square, rectangular, or other similar shaped or sized spice bottles 34 are situated parallel to the adjacent top wall 38, bottom wall 40, sidewalls 42 and 44, and base 36, respectively. In this manner, the compartment 32 is designed to accommodate the varying shapes and sizes of said square, rectangular, or other similar shaped spice bottles 34 and retain them in position within the compartment 32.

The slot 46 is designed to receive any circular or other similar shaped or sized spice bottles 34. This is accomplished by the combination of the opening 60 and the supporting walls 62 and 64 (see also FIG. 4). When a circular or other similar shaped or sized spice bottles 34 are inserted into one of the plurality of compartments 32, a portion 68 of the circular or other similar shaped or sized spice bottles 34 is received into the opening 60 of the base 36 and held by the opposing supporting walls 62 and 64, thereby, retaining and holding the spice bottles 34 in place within the compartments 32 and further assisting in preventing the spice bottles 34 from spinning, or otherwise rotating or moving, within the compartments 32. In this manner, the compartment 32 is also designed to accommodate the varying shapes and sizes of said circular or other similar shaped spice bottles 34 and retain them in position within the compartment 32.

To retrieve the spice bottles 34 or containers from the spice rack 20, the cook or user will pull the spice drawer 28 out from the spice rack 20 into the fully extended position or the open or displaying position as shown in phantom, as illustrated in FIG. 1. It is further contemplated that any means may be used to enable the user to grab and pull out any spice drawer 34 such as knobs, handles, or any other means known to one skilled in the art.

As the spice drawer 28 is being pulled out from the spice rack 20 (i.e., in a direction outwardly away from the spice rack 20) and into the fully extended position, each of the spice bottles 34 are neatly organized in the plurality of compartments 32 and visibly displayed along with their labels for selection. When the spices from the spice drawer 28 are no longer required, the spice drawer 28 is returned to the spice rack 20 in the opposite manner to the closed or storage position. As a result, the cook or user may simply lift the spice drawer 28 upward until the spice drawer 28 can be slid straight or directly back into the the spice rack 20. In an alternate embodiment, the spice drawer 28 may be completely removed from the spice rack 20. After the spice drawer 28 is removed from the spice rack 20, any means known to one skilled in the art may be utilized to display the spice drawer 28 in its desired orientation for displaying and accessing the spice bottles 34 contained within the spice drawer 28. This includes, for example, but is not limited to a pivoting set-up, a picture frame set-up, as a retaining wall, etc. . . . .

Thus, there has been provided Applicant's unique portable spice rack device for organizing, storing, and retrieving varying shaped and sized spice bottles or other types of containers. While the invention has been described in conjunction with specific embodiments, it is evident that many alternatives, modifications and variations will be apparent to those skilled in the art in light of the foregoing description. Accordingly, it is intended to embrace all such alternatives, modifications and variations as fall within the spirit and scope of the description, drawings, and claims.

What is claimed is:

1. A portable device for storing and retrieving bottles, comprising:

a housing having a top, a bottom, and opposed sides, and further defining a front end and a back end;

a plurality of drawers in slidable communication between the opposed sides; each of the plurality of drawers independently moveable in relation to the housing from a storage position to a fully extended position;

a plurality of compartments formed in each of the plurality of drawers, each of the plurality of compartments providing a top wall, a bottom wall, opposed sidewalls, and a substantially flat base, the substantially flat base comprising two distinct and spaced apart flat sections that are separated by a slot that extends from the top wall to the bottom wall;

the top wall, the bottom wall, and the opposed sidewalls each extending upwardly from each of the flat sections in substantially a vertical orientation and are situated at substantially a perpendicular angle to one another and to the flat sections; the top wall, the bottom wall, the opposed sidewalls, and the flat sections retaining a varying shaped bottle within the compartment;

the slot providing opposed supporting walls and defining an opening between the flat sections and extending from the top wall to the bottom wall, the slot further defining a retaining plane, a circular shaped bottle aligned with the retaining plane with a portion of the circular shaped bottle being received through the opening whereby the circular shaped bottle is engagedly held in position anywhere within the slot by the opposed supporting walls; and the varying shaped bottle is stacked in the retaining plane in the compartment either above or below the circular shaped bottle, the varying shaped bottle either being of the same or a different shape from the circular shaped bottle.

2. The portable device of claim 1 wherein the slot is positioned in substantially the center of the base between the opposed sidewalls.

3. The portable device of claim 1 wherein each of the opposed supporting walls are situated at substantially a forty-five degree angle in relation to the base.

4. The portable device of claim 1 wherein, when the plurality of drawers is in the fully extended position, both the varying shaped bottle and the circular shaped bottle are visibly displayed within the compartment.

5. A drawer for storing and retrieving bottles, comprising:

the drawer having a plurality of compartments, each of the plurality of compartments providing a top wall, a bottom wall, opposed sidewalls, and a base, the base segmented into two distinct substantially flat sections by a slot that extends from the top wall to the bottom wall;

the top wall, the bottom wall, and the opposed sidewalls each extending upwardly from each of the flat sections in substantially a vertically orientation and are situated at substantially a perpendicular angle to one another and to the flat sections, the plurality of compartments each defining a retaining plane from the top wall to the bottom wall in the center of the base between the opposed sidewalls, each of the plurality of compartments retaining a varying shaped bottle along the retaining plane and between the opposed sidewalls of the plurality of compartments;

the slot situated in each of the plurality of compartments along the retaining plane, the slot providing opposed supporting walls aligned parallel to the opposed sidewalls and defining an opening between them, the opposed supporting walls and opening extending from the top wall to the bottom wall;

the opposed supporting walls and opening retaining a circular shaped bottle along the retaining plane within each of the plurality of compartments, the circular shaped bottle having a flat top, a round body, and a flat bottom, the round body of the circular shaped bottle being received through the opening whereby the circular shaped bottles is engagedly held in position within the slot by the opposed supporting walls anywhere between the top wall and the bottom wall of the plurality of compartments; and whereby, the varying shaped bottle is stacked in the retaining plane in one or more of the plurality of compartments either above or below the circular shaped bottle, the varying shaped bottle either in physical engagement with the flat top of the circular shaped bottle with the flat bottom of the circular shaped bottle in physical engagement with the bottom wall or the varying shaped bottle in physical engagement with the flat bottom of the circular shaped bottle with the flat top of the circular shape bottle in physical engagement with the top wall.

6. The drawer of claim 5 wherein the drawer is in slidable communication with a housing, the drawer moveable in relation to the housing from a storage position to a fully extended position.

7. The drawer of claim 6 wherein, when the drawer is in the fully extended position, each of the plurality of compartments are exposed with the varying shaped bottle and the circular shaped bottle visibly displayed within each of the plurality of compartments.

8. The drawer of claim 7 wherein each of the plurality of compartments are separated into a plurality of rows.

* * * * *